US010064467B2

(12) United States Patent
Bosscher et al.

(10) Patent No.: US 10,064,467 B2
(45) Date of Patent: Sep. 4, 2018

(54) PROTECTIVE ENCLOSURE FOR AN ELECTRONIC DEVICE

(71) Applicant: Apple Inc., Cupertino, CA (US)

(72) Inventors: Nathan P. Bosscher, Madison, WI (US); Erik L. Wang, Redwood City, CA (US); Ethan L. Huwe, Davis, CA (US); Craig M. Stanley, Campbell, CA (US)

(73) Assignee: Apple Inc., Cupertino, CA (US)

( * ) Notice: Subject to any disclaimer, the term of this patent is extended or adjusted under 35 U.S.C. 154(b) by 128 days.

(21) Appl. No.: 15/264,484

(22) Filed: Sep. 13, 2016

(65) Prior Publication Data

US 2017/0079394 A1 Mar. 23, 2017

Related U.S. Application Data

(60) Provisional application No. 62/220,900, filed on Sep. 18, 2015.

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01)

(58) Field of Classification Search
CPC ..... A45C 11/00; A45C 2011/002; A45C 2011/003
See application file for complete search history.

(56) References Cited

U.S. PATENT DOCUMENTS

| | | | | |
|---|---|---|---|---|
| 6,981,085 | B2 | 12/2005 | Tree et al. | |
| 8,286,789 | B2 | 10/2012 | Wilson et al. | |
| 2007/0215663 | A1 | 9/2007 | Chongson et al. | |
| 2010/0124040 | A1* | 5/2010 | Diebel | G06F 1/1628 361/816 |
| 2013/0069499 | A1 | 3/2013 | Modrell | |
| 2017/0047960 | A1* | 2/2017 | Kil | H04B 1/3888 |
| 2017/0338846 | A1* | 11/2017 | Lee | G06F 3/048 |
| 2017/0353208 | A1* | 12/2017 | Wilson | H04M 1/18 |

* cited by examiner

*Primary Examiner* — Nabil Syed
(74) *Attorney, Agent, or Firm* — Dickinson Wright RLLP

(57) ABSTRACT

An accessory device used with an electronic device is disclosed. The accessory device may provide a protective cover for the electronic device. The accessory device may include a first part and a second part. The accessory device may also include one or more detection mechanisms, some of which may be used to determine whether the first part and the second part are properly aligned with respect to each other. Further, the detection mechanisms may generate an indication whether the first and second parts are properly aligned. The detection mechanism may be in communication with the electronic device such that the electronic device can receive the indication. In this manner, the indication may cause the electronic device to generate and present a message on a display of the electronic device. The message may provide a statement whether the parts are properly aligned.

19 Claims, 8 Drawing Sheets

PROTECTIVE ENCLOSURE FOR AN ELECTRONIC DEVICE

CROSS-REFERENCE TO RELATED APPLICATION(S)

This application claims the benefit of priority under 35 U.S.C. § 119(e) to U.S. Provisional Application No. 62/220,900, filed on Sep. 18, 2015, and titled "PROTECTIVE ENCLOSURE FOR AN ELECTRONIC DEVICE," the disclosure of each is incorporated herein by reference in its entirety.

FIELD

The following description relates to an accessory device used with an electronic device. In particular, the following description relates to an accessory device designed to communicate with the electronic device. The communication may include an indication of whether the electronic device is disposed in the accessory device, and/or whether the accessory device is properly secured together and aligned with the electronic device.

BACKGROUND

Accessory devices are known to provide a protective cover for an electronic device. In order to provide a suitable protective cover, some accessory devices include multiple parts that must be assembled or fit together. However, assembling multiple parts may lead to several problems. For example, while the parts may appear properly fit together, the parts may not be fit together in a manner intended by the manufacturer. As a result, the accessory device may not provide a sufficient protective cover. Further, some accessory devices having multiple parts may be designed to prevent ingress of contaminants through the accessory device (when the accessory device is fully assembled). In these instances, when the accessory device is improperly assembled, the accessory device may not prevent the ingress of the contaminants. This may result in ingress entering through the accessory device and into the electronic device, causing damage to the electronic device.

SUMMARY

In one aspect, an accessory device suitable for use with an electronic device having a display is described. The accessory device may include a body configured to receive the electronic device. The accessory device may further include a detection mechanism carried by the body and configured to provide an indication to the electronic device when the electronic device is in the body. The indication may trigger the electronic device to present on the display a message in accordance with the body receiving the electronic device.

In another aspect, an accessory device suitable as a protective cover for an electronic device is described. The accessory device may include a first part. The accessory device may further include a second part that combines with the first part to provide the protective cover. The accessory device may further include a detection mechanism configured to detect a coupling between the first part and the second part and communicate the coupling to the electronic device.

In another aspect, a method for forming an accessory device suitable as a protective cover for an electronic device is described. The method may include forming a first part and a second part that combines with the first part to provide the protective cover. The method may further include providing a detection mechanism configured to detect a coupling between the first part and the second part and communicate the coupling to the electronic device.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
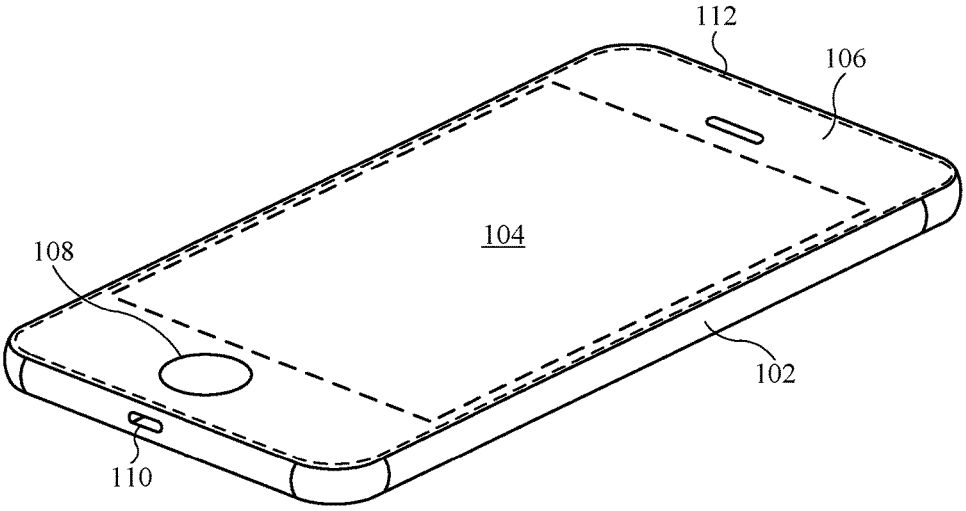
FIG. 1 illustrates an isometric view of an embodiment of an electronic device.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to an accessory device suitable for use with an electronic device. The accessory device may define a protective cover or case for the electronic device. In some instances, the accessory device may include a first part designed to couple with a second part, with the first part and the second part combining to enclose the electronic device. Further, in order to assist a user in determining proper installment between the two parts, the accessory device may include several features. For example, the accessory device may include a detection mechanism, or sensor, designed to detect whether the electronic device is present in the accessory device. The sensor may include an electrical contact designed to electrically couple with an electrical contact of the electronic device, thereby allowing direct communication between the accessory device and the electronic device. In this manner, using the detection mechanism, the accessory device may communicate to the electronic device that the electronic device is present in the accessory device.

Further, at least one of the parts (of the accessory device) may include several additional detection mechanisms designed to determine whether the two parts are properly aligned with one another by detecting the presence of certain structural components. For example, the first part may include several tabs, or extensions, each of which being designed to mate with a receptacle in the second part. Each receptacle (or at least one of the receptacles) may include a sensor positioned proximate to the receptacle to detect whether a tab is positioned in its respective receptacle. Each sensor may provide an input to the accessory device, or a processor circuit of the accessory device, and based on the inputs, the accessory device (or the processor circuit) may communicate to the electronic device whether the accessory device is properly installed. Accordingly, the communication may include an indication that each sensor detects its respective tab in a receptacle. Alternatively, when the accessory device does not include a processor circuit, each sensor may provide an input, as an electrical signal, to the electronic device to indicate whether the sensor detects a tab in its respective receptacle. Accordingly, in either event, the electronic device can receive information whether the accessory device is properly installed with the electronic device. Also, in some embodiments, the communication is provided through electrical contacts and embedded flexible circuits throughout the accessory device. In other embodiments, the accessory device and the electronic device may establish wireless communication by, for example, Bluetooth, near field communication ("NFC"), and/or 802.11 (Wi-Fi) protocol, to provide the indication whether the accessory device is properly installed.

Also, the electronic device may use the indication to display a message on a display of the electronic device. The message may indicate to a user whether the accessory device is properly installed on the electronic device. For instance, the message may include a statement that the accessory device is properly assembled/installed, thereby providing a confirmation to the user that the accessory device needs no further action. Alternatively, the message may include a statement that the accessory device is not properly installed/assembled, and may further suggest a corrective action to the user, with the corrective action including instructions to correct the issue and properly install the accessory device with the electronic device.

The accessory device may also include a latch mechanism designed to lock the first part together with the second part. The user may actuate the latch mechanism to place the accessory device in a locked configuration or an unlocked configuration. The locked configuration holds the first and second parts together, while the unlocked configuration allows the first and second parts to separate to remove the electronic device. The accessory device may include a sensor positioned proximate to the latch mechanism to determine the position of the latch mechanism. For example, the sensor may detect whether the latch mechanism is in the locked and/or unlocked configuration, and provide an input to the accessory device that triggers communication to the electronic device of the locked or unlocked configuration. The electronic device may use the communication to generate and display a message (on the display) indicating whether the accessory device is locked or unlocked, and may further suggest a corrective action to lock the latch mechanism when the accessory device is unlocked.

In order to provide additional protection to the electronic device, the accessory device may include a sealing element formed from a compressible material, such as silicone. When the accessory device encloses the electronic device, the sealing element may engage the electronic device, and in particular, a protective layer (such as a transparent cover glass that overlays the display) of the electronic device. Further, the sealing element may engage and compress against the electronic device to provide an ingress barrier as well as protection against shock when, for example, the electronic device is dropped. Also, the sealing element may be disposed in the first part that is designed to cover a front portion of the electronic device associated with the display and the protective layer. In some instances, the first part includes an opening (free of any transparent layer) to allow direct access to the protective layer and the display. In this regard, when the display includes a capacitive touch sensitive layer, the first part allows the user to access and interact with the display, by capacitive means, while the sealing element protects against ingress entering through an interface between the sealing element and the protective layer.

Also, in some embodiments, the electronic device includes a force detection sensor, or force detection layer, designed to sense an amount of force applied to the display. Further, the force detection sensor may also detect an amount of force applied by the aforementioned sealing element to the protective layer. For example, when the first part is assembled with the second part and the sealing element is positioned between the first part and the protective layer, the electronic device may determine whether the sealing element is properly aligned and engaged with the protective layer based upon the force detected by the force detection sensor at the protective layer. The electronic device may compare the detected amount of force with a predetermined amount of force, and generate and present a message on the display indicating whether the sealing element is properly aligned and/or engaged with the electronic device, and in particular, the protective layer. It should be noted that proper alignment/engagement is associated with the detected amount of force being within a tolerance of the predetermined amount of force, or within a predetermined range of force. The message may include a statement that the sealing element is properly aligned with the protective layer, thereby providing a confirmation to the user that the accessory device needs no further action. Alternatively, the message may include a statement that the sealing element is not properly aligned with the protective layer, and may further suggest a corrective action to the user, which may include instructions to place the sealing element in proper alignment.

These and other embodiments are discussed below with reference to FIGS. 1-10. However, those skilled in the art will readily appreciate that the detailed description given herein with respect to these Figures is for explanatory purposes only and should not be construed as limiting.

FIG. 1 illustrates an isometric view of an embodiment of an electronic device 100. In some embodiments, the electronic device 100 is a tablet device. In the embodiment shown in FIG. 1, the electronic device 100 is a mobile communication device, such as a smartphone. The electronic device 100 may include an enclosure 102 designed to enclose several operational components, including integrated circuits, a speaker, a microphone, as non-limiting examples. In some embodiments, the enclosure 102 is formed from a metal, such as aluminum or an aluminum alloy. The electronic device 100 may further include a display 104 designed to display visual information. The display 104 may include a touch-sensitive layer (not shown) integrated with the display 104 such that the display 104 can receive and respond to a touch input by a user. Further, the touch-sensitive layer may include a capacitive touch sensitive layer that receives and responds to a capacitive coupling with the capacitive touch sensitive layer. The electronic device 100 may also include an outer protective layer 106 overlaying the display 104. The outer protective layer 106 may include a transparent material, such as glass or sapphire, that covers the display 104.

Also, the electronic device 100 may further include a button 108 designed to receive an additional input, allowing a user to provide a control to the electronic device 100. The button 108 may be used to control, for example, a software application or "app" visually presented on the display 104. The electronic device 100 may include an internal power source (not shown) used to provide electrical current to several operational components of the electronic device 100. Accordingly, the electronic device 100 may include a charging port 110 designed to receive power in order to provide power to the internal power source and/or the internal components. Also, although not shown, the electronic device 100 may include one or more control inputs (such as button) positioned along various locations around the enclosure 102, with the control inputs offering different control features for the electronic device 100.

Also, the electronic device 100 may include a force detection layer 112 (shown as a dotted line) disposed below the outer protective layer 106, and designed to detect a force or pressure applied to the outer protective layer 106 and/or the display 104. Further, the force detection layer 112 may detect an amount of force or pressure applied to the outer protective layer 106 and/or the display 104. The electronic device 100 may include a processor circuit (not shown) designed to receive an input from the force detection layer 112 indicating an amount of force received at the outer protective layer 106 and/or the display 104. This will be further discussed below.

Figure 2:
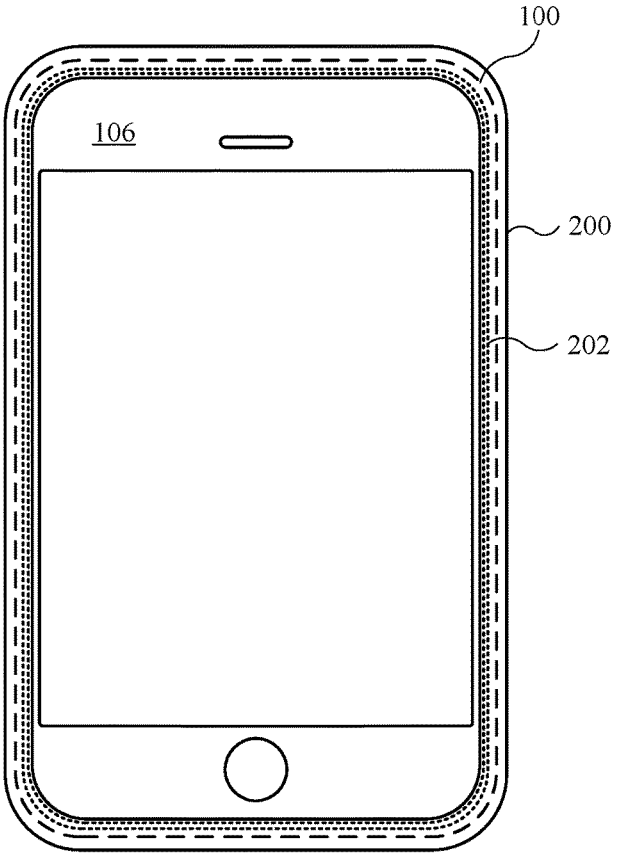
FIG. 2 illustrates a plan view of the electronic device shown in FIG. 1, showing the electronic device disposed in an embodiment of an accessory device, in accordance with the described embodiments.

FIG. 2 illustrates a plan view of the electronic device 100 shown in FIG. 1, showing the electronic device 100 disposed in an embodiment of an accessory device 200, in accordance with the described embodiments. The accessory device 200 generally covers an outer perimeter of the electronic device 100, such as the enclosure 102 (shown and labeled in FIG. 1). Further, as shown in FIG. 2, the accessory device 200 may cover a portion of the outer protective layer 106. Further, in some embodiments, the accessory device 200 includes a sealing element 202 positioned between the accessory device 200 and the outer protective layer 106. Also, the sealing element 202 is designed and positioned to engage the outer protective layer 106. In some embodiments, the sealing element 202 includes a compressible material, such as silicone or including liquid silicone rubber. Also, when the electronic device 100 is disposed in the accessory device 200 (as shown in FIG. 2), the sealing element 202 may compress based in part on a force (or forces) provided by the accessory device 200 and the outer protective layer 106. This allows the sealing element 202 to firmly engage the outer protective layer 106 and provide a sealing barrier against ingress attempting to enter an interface between the sealing element 202 and the outer protective layer 106. Accordingly, the sealing element 202 may prevent ingress of contaminants from entering the electronic device 100. This will be shown and described below.

Figure 3:
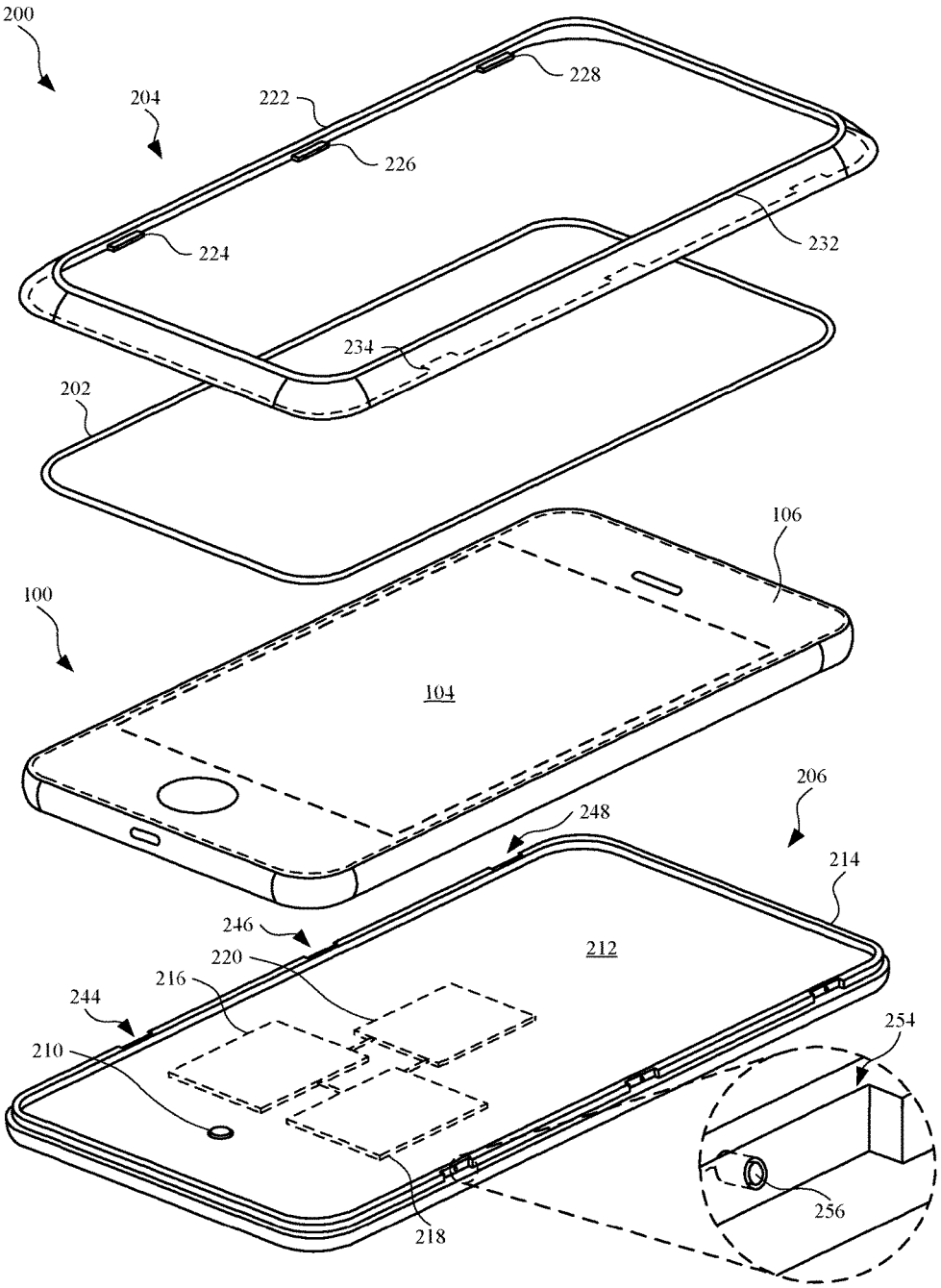
FIG. 3 illustrates an exploded view of the accessory device shown in FIG. 2, showing various features that may be designed to interact with the electronic device or with other features of the accessory device.

FIG. 3 illustrates an exploded view of the accessory device 200 shown in FIG. 2, showing various features designed to interact with the electronic device 100 or with other features of the accessory device 200. The accessory device 200 may include several parts that secure together to define a body that provides a protective enclosure for the electronic device 100. For example, the accessory device 200 may include a first part 204 and a second part 206 designed to mechanically couple with the first part 204. In some embodiments, the first part 204 and the second part 206 are formed from a rigid polymer material, such as plastic. Further, the first part 204 may couple with the second part 206 such that the sealing element 202 is positioned between the first part 204 and the outer protective layer 106. Also, although not shown, the first part 204 and/or the second part 206 may include an outer cover formed from a material such as silicone or leather. Generally, the outer cover may include any material designed to enhance an appearance of the accessory device 200.

The accessory device 200 may include a surface 212 designed to receive the electronic device 100. The surface 212 may include an electrical contact 210 designed to electrically couple with an electrical contact (not shown) of the electronic device 100 when the electronic device 100 is positioned on the surface 212. The electrical contact 210 may be positioned anywhere on the surface 212 such that the electrical contact 210 is in a location corresponding to the electrical contact of the electronic device 100. The electrical contact 210 may allow the accessory device 200 to communicate with the electronic device to, for example, provide an indication (in the form of an electronic signal or signals) to the electronic device 100 whether the electronic device 100 is positioned on the surface 212, and in particular, whether the electronic device 100 is properly aligned with the second part 206. A "proper alignment" of an electronic device with the second part refers to the electronic device 100 resting on the surface 212 and within sidewalls 214 extending around the surface 212. The electrical contact 210 may allow the accessory device 200 to provide other forms of communication with the electronic device 100, and will be discussed below. Alternatively, the communication may pass via wireless communication between the accessory device 200 and the electronic device 100, with the wireless communication taking the form of Bluetooth, near field communication ("NFC"), and/or 802.11 (Wi-Fi) protocol.

Further, when the electronic device 100 is positioned on the surface 212, the electrical contact 210 may generate an input to a processor circuit 216 disposed in the second part 206 below the surface 212. The processor circuit 216 may run a program (or programs) stored on a memory circuit 218 also disposed in the second part 206 below the surface 212. A battery 220 disposed in the second part 206, and below the surface 212, may provide power to the processor circuit 216 and the memory circuit 218. If the electronic device 100 is properly aligned, the processor circuit 216 may use the input from the electrical contact 210, and based on the input, generate an output to the electronic device 100 to communicate to the proper alignment to the electronic device 100. Conversely, if the electronic device 100 is not properly aligned, corresponding to an "error," the accessory device 200 may provide a different output to the electronic device 100 indicating the improper alignment. In either event, the electronic device 100 may generate a message, based upon the output from the processor circuit 216, that is presented on the display 104, indicating to a user whether the electronic device 100 is properly aligned. For example, when the electronic device 100 is not properly installed, the message may indicate the improper alignment and further suggest a corrective action to the user to place the electronic device 100 in proper alignment.

Also, the indication from the accessory device 200 may include an indication whether the electronic device 100 is compatible with the accessory device 200. For example, the accessory device 200 may include a size and shape for a particular electronic device (in terms of design and/or model), and when the particular electronic device is not detected, the accessory device 200 may communicate this information to the electronic device 100, causing the electronic device 100 to provide a message on the display 104 that the electronic device 100 is incompatible with the accessory device 200.

The first part 204 may include several features designed to couple with the second part 206. For example, the first part 204 may include a first sidewall 222 having several extensions, or tabs, such as a first extension 224, a second extension 226, and a third extension 228 along the first sidewall 222. Also, as shown, the first part 204 includes a second sidewall 232 opposite the first sidewall 222 that also include several extensions. The second part 206 may include several receptacles designed to receive the extensions. For example, the second part 206 may include a first receptacle 244, a second receptacle 246, and a third receptacle 248 designed to receive the first extension 224, the second extension 226, and the third extension 228, respectively, when the first part 204 is coupled with the second part 206. Also, the second part 206 may further include additional receptacles (not labeled) designed to receive a corresponding number of extensions (shown as dotted lines) positioned along the second sidewall 232. Although a discrete number of extensions in particular locations of the first part 204 are shown, a different number of extensions may be disposed along any of the sidewalls of the first part 204. Accordingly, the second part 206 may include a corresponding number of receptacles in corresponding locations. Although not shown, one or more additional mechanical features may be used to couple the first part 204 with the second part 206.

The accessory device 200 may include features designed to determine whether the first part 204 is secured with the second part 206. For example, as shown in the enlarged view, the second part 206 may include a fourth receptacle 254 having a detection mechanism 256. The detection mechanism 256 may detect the presence of an extension in the first part 204, such as a fourth extension 234. Based upon the detection, the detection mechanism 256 may provide an input to indicate the fourth extension 234 is positioned within the fourth receptacle 254. The processor circuit 216 may receive the input (in the form of an electrical signal) from the detection mechanism 256 via an electrical coupling (not shown).

In some embodiments, the detection mechanism 256 is a mechanical switch that is driven or actuated in response to the fourth extension 234 mechanically coupling with the detection mechanism 256, causing the detection mechanism 256 to close an electrical circuit (not shown) and generate an electrical signal to the processor circuit 216 indicating the fourth extension 234 is in the fourth receptacle 254. In other embodiments, the detection mechanism 256 includes a solid-state proximity sensor, such as a capacitive sensor designed to detect a change in capacitance at a surface of the capacitive sensor, with the change in capacitance indicating the fourth extension 234 is in the fourth receptacle 254. The detection mechanism 256 may include an alternative solid-state proximity sensor, such as a photoelectric sensor that emits light (which may be infrared) and detects the light reflected from the fourth extension 234, indicating the fourth extension 234 is in the fourth receptacle 254. Still, in other embodiments, the detection mechanism 256 includes a Hall Effect sensor designed to detect an external magnetic field. In this regard, the fourth extension 234 may include a magnet (not shown) capable of producing the external magnetic field detected by the detection mechanism 256 when the fourth extension 234 is disposed in the fourth receptacle 254. It should be noted that any described receptacle may include a detection mechanism similar to the detection mechanism 256 to carry out a similar function as that of the detection mechanism 256.

Each detection mechanism may electrically couple with, and provide an input to, the processor circuit 216, which may use the inputs to provide an indication to the electronic device 100 whether the first part 204 is aligned with respect to the second part 206. The first part 204 may be "properly aligned" with the second part 206 when each extension of the first part 204 is positioned in a receptacle of the second part 206, and detected by an aforementioned detection mechanism. Accordingly, if any one of the detection mechanisms does not detect an extension in a receptacle, the processor circuit 216 may generate an output to the electronic device 100 indicating the first part 204 is not properly aligned with the second part 206. The output may be in the form of an electrical signal or wireless communication.

A detection mechanism herein may communicate with the processor circuit 216 by different means. For example, the detection mechanism may include a "normally closed" circuit such that the detection mechanism is in communication (including electrical communication) with the processor circuit 216 until the detection mechanism detects the extension. Accordingly, the termination of communication indicates the extension is present in the receptacle. Alternatively, the detection mechanism may include a "normally open" circuit such that the detection mechanism is not in communication with the processor circuit 216 until the detection mechanism detects the extension. Accordingly, the presence of communication between the detection mechanism and the processor circuit indicates the extension is present in the receptacle. The processor circuit 216 may be configured for either type of circuit, such that an "error" corresponds to logic indicating that the extension is not detected in the receptacle by the detection mechanism. Also, the processor circuit 216 may be configured to receive and process multiple inputs, including an input from each detection mechanism of the second part 206.

When the processor circuit 216 determines the first part 204 is not properly aligned with the second part 206, the processor circuit 216 may generate an output to the electronic device 100 indicating to the electronic device 100 that the first part 204 is not properly aligned with respect to the second part 206. The means for passing the message or indication from the accessory device 200 (or the processor circuit 216) to the electronic device 100 may include any means previously described for communication between the accessory device 200 and the electronic device 100. This may cause the electronic device 100 to generate a message, based upon the message or indication from the accessory device 200, presented on the display 104 of the electronic device 100, indicating to a user that the first part 204 is not properly aligned with respect to the second part 206. The message may further suggest a corrective action to the user.

Figure 4:
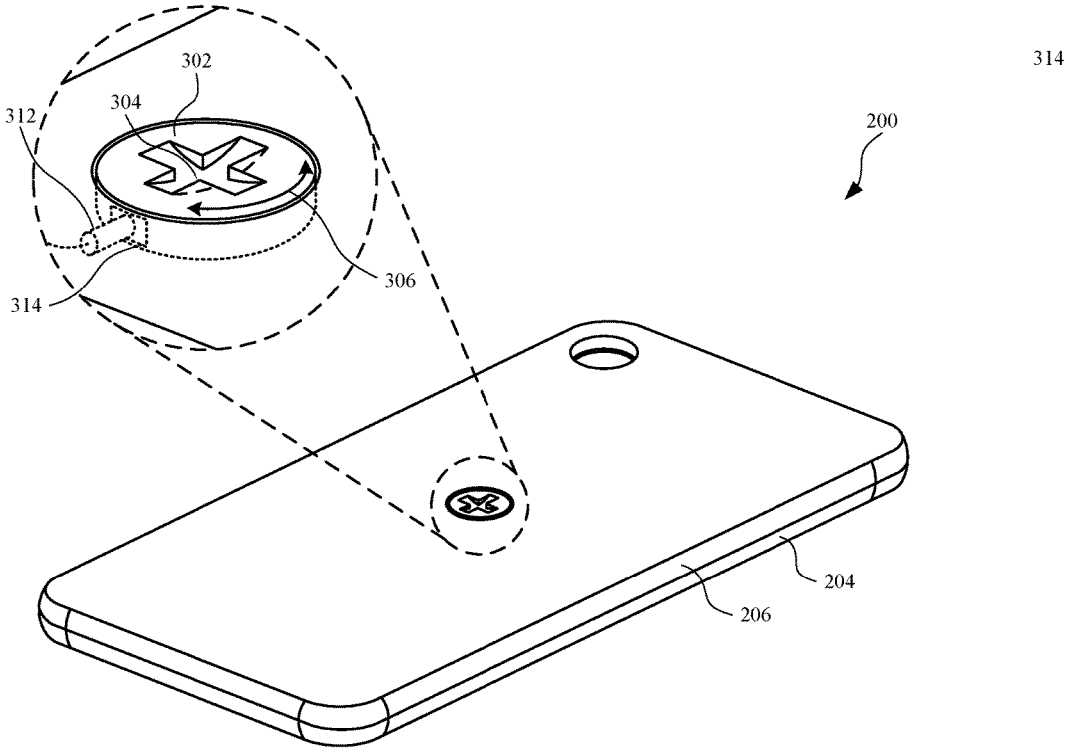
FIG. 4 illustrates an isometric view of a rear portion of the accessory device, showing a latch mechanism designed to lock the first part with the second part, or unlock the first part from the second part.

FIG. 4 illustrates an isometric view of a rear portion of the accessory device 200, showing a latch mechanism 302 designed to lock the first part 204 with the second part 206, or unlock the first part 204 from the second part 206. A locked configuration of the accessory device 200 may refer to the latch mechanism 302 maintaining an engagement between the first part 204 and the second part 206. In this regard, the first part 204 and the second part 206 may include one or more locking components (not shown) that couple with one another in the locked configuration, and are controllable by movement of the latch mechanism 302. An unlocked configuration of the accessory device 200 may refer to the latch mechanism 302 allowing the first part 204 to disengage from the second part 206, or vice versa. In this regard, the aforementioned locking components may decouple from one another based on movement of the latch mechanism 302.

A rotation of the latch mechanism 302 may cause a locking and unlocking between the first part 204 and the second part 206. In this regard, the latch mechanism 302 may include a recessed portion 304 designed to receive an object or tool (not shown) used to rotationally drive the latch mechanism 302 bi-directionally, denoted by the two-sided arrow 306. The recessed portion 304 includes a shape that may receive a tool, such as a Philips screwdriver. However, the recessed portion 304 may include various sizes and shapes, some of which may correspond to a size and a shape of another object or tool. Also, in some embodiments, the latch mechanism 302 is positioned near a corner of the second part 206. However, in the embodiment shown in FIG. 4, the latch mechanism 302 is located in a central region, or approximately the central region, of the second part 206.

The accessory device 200 may further include a detection mechanism 312 positioned proximate to the latch mechanism 302, and designed to determine a configuration of the latch mechanism 302, such as the locked configuration and/or the unlocked configuration. In this regard, the latch mechanism 302 may include a target 314 identified by the detection mechanism 312 when the target 314 is within sufficient proximity to the detection mechanism 312, thereby indicating the latch mechanism 302 is in the locked configuration. For example, as shown in FIG. 4, the target 314 is positioned the detection mechanism 312 can detect the target 314. The detection mechanism 312 may be electrically coupled with the processor circuit 216 (shown in FIG. 3) to provide communication to the processor circuit 216 information related to the locked and/or the unlocked configuration.

In some embodiments, the detection mechanism 312 is a mechanical switch designed to open or close based upon a mechanical coupling between the latch mechanism 302 and the detection mechanism 312. In other embodiments, the detection mechanism 312 includes a proximity sensor, such as a capacitive or photoelectrical sensor, designed to provide an input to the processor circuit 216 based on a detection of the target 314, with the input corresponding to a locked configuration, as an example. In the embodiment shown in FIG. 4, the latch mechanism 302 includes an inductive proximity sensor designed to detect a metal. In this regard, the target 314 may include a metal detectable by the detection mechanism 312 when the target 314 is within sufficient proximity to the detection mechanism 312. This may occur by rotating the latch mechanism 302 to position the target 314 within sufficient proximity to the detection mechanism 312. The detection of the target 314 by the detection mechanism 312 may correspond to a locked configuration. Still, in other embodiments, the latch mechanism 302 includes an encoder having a rotary disc. In this regard, the detection mechanism 312 may be positioned below the latch mechanism 302, and configured to detect light from a light source passing through an opening (or openings) of the rotary disc. As the latch mechanism 302 turns, the detection mechanism 312 detects the light passing through the opening (or openings) in a predetermined manner that corresponds to a locked configuration, as an example. In the foregoing embodiments, the detection mechanism 312 may provide an indication of the locked configuration (when, for example, the target 314 is detected) as well as the unlocked configuration. Alternatively, the detection mechanism 312 may provide an indication only when the target 314 is detected, corresponding to the locked configuration.

The detection mechanism 312 may be configured to provide an input to the processor circuit 216 (in the form of an electrical signal) when the latch mechanism 302 is in the locked or unlocked configuration. In either configuration, the processor circuit 216 may provide an output to the electronic device 100 (shown in FIG. 3), indicating the configuration the latch mechanism. The means for passing the message or indication from the accessory device 200 (or the processor circuit 216) to the electronic device 100 may include any means previously described for communication between the accessory device 200 and the electronic device 100. Based upon the output from the accessory device 200, the electronic device 100 may generate and present a message on the display 104 (shown in FIG. 1), indicating to a user that the latch mechanism 302 is in the locked or unlocked position. The message may further suggest a corrective action to the user if the latch mechanism 302 is in the unlocked configuration.

The detection mechanisms shown and described in FIGS. 3 and 4 may be designed to monitor conditions according to a predetermined time interval. For example, the detection mechanism 312 may monitor the latch mechanism 302 every 20 seconds. Further, the predetermined time interval may be set by the user in order to conserve battery power in the accessory device 200, as less monitoring may result in less battery power consumption. Alternatively, the detection mechanisms may monitor conditions in real-time in order to provide any changes to the conditions immediately. This may allow the user to be notified as soon as an undesired situation occurs, such as the detection mechanism 256 no longer detecting the fourth extension 234 (shown in FIG. 3). The real-time monitor function may be incorporated according to a user setting.

Figure 5:
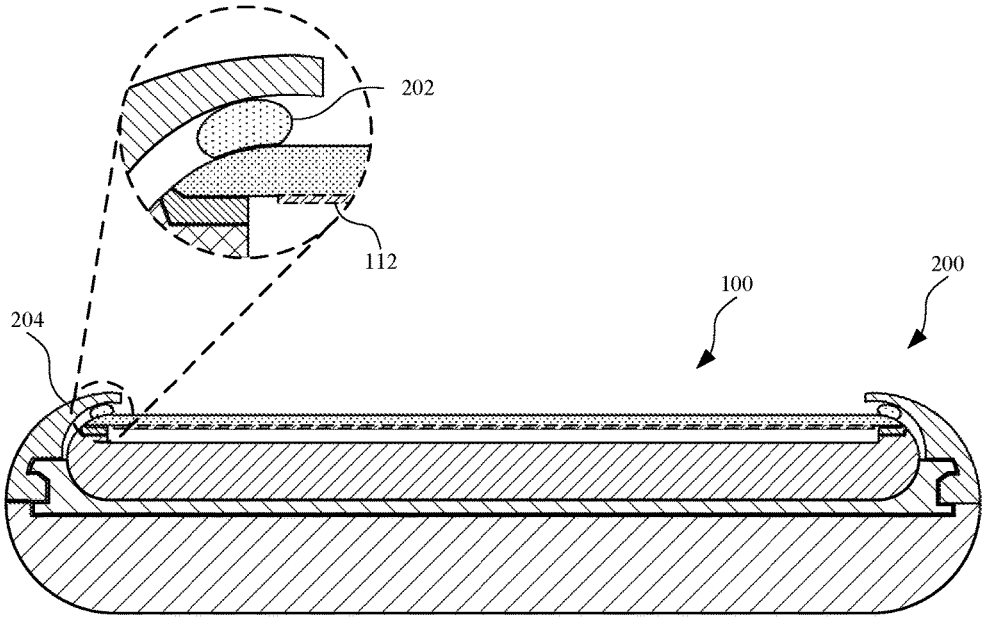
FIG. 5 illustrates a cross sectional view of the accessory device carrying the electronic device, further showing the sealing element engaging the electronic device.

FIG. 5 illustrates a cross sectional view of the accessory device 200 carrying the electronic device 100, further showing the sealing element 202 engaging the outer protective layer 106. For purposes of simplicity, the display 104 (shown in FIG. 1) is removed. The sealing element 202 may be positioned between the accessory device 200 and the electronic device 100, and in particular, between the first part 204 and the outer protective layer 106. In this regard, by securing together the first part 204 with the second part 206, the sealing element 202 is compressed against between the outer protective layer 106 and the first part 204. Further, as shown in the enlarged view, the sealing element 202 may change its size and shape in response to compression forces from the first part 204 and the outer protective layer 106, and elastically deform to the contour of the outer protective layer 106. This may create an ingress barrier at an interface between the sealing element 202 and the outer protective layer 106 to prevent ingress into the electronic device 100.

Further, the sealing element 202 may provide a counterforce to the outer protective layer 106. The electronic device 100 may be designed detect the counterforce from the sealing element 202. For example, the force detection layer 112 may detect a force applied to the outer protective layer 106 from the sealing element 202. A processor circuit (not shown) of the electronic device 100 may receive an input from the force detection layer 112 (in the form of an electrical signal), with the input corresponding to an amount of detected force from the sealing element 202 to the outer protective layer 106. The amount of detected force may be compared with a predetermined amount of force, or a predetermined range of force, consistent with a force known to compress the sealing element 202 without causing damage to the electronic device 100. Further, when the amount of detected force within an acceptable tolerance of the predetermined amount of force, or within the predetermined range of force, the electronic device 100 determines the accessory device 200 is properly installed with the electronic device 100. Also, the electronic device 100 may monitor (continuously or at intervals) the force received from the accessory device 200 (and in particular, from the sealing element 202) to determine whether the force is within the tolerance or within the predetermined range. If any location of the outer protective layer does not receive a force within the tolerance or within the predetermined range, the electronic device 100 may provide an indication to a user that the accessory device 200 is not properly installed. The indication may include a message presented on the display (not shown), and may further provide a corrective action to the user. In this manner, the accessory device 200 may offer an ingress barrier monitored in real-time by the electronic device 100.

Figure 6:
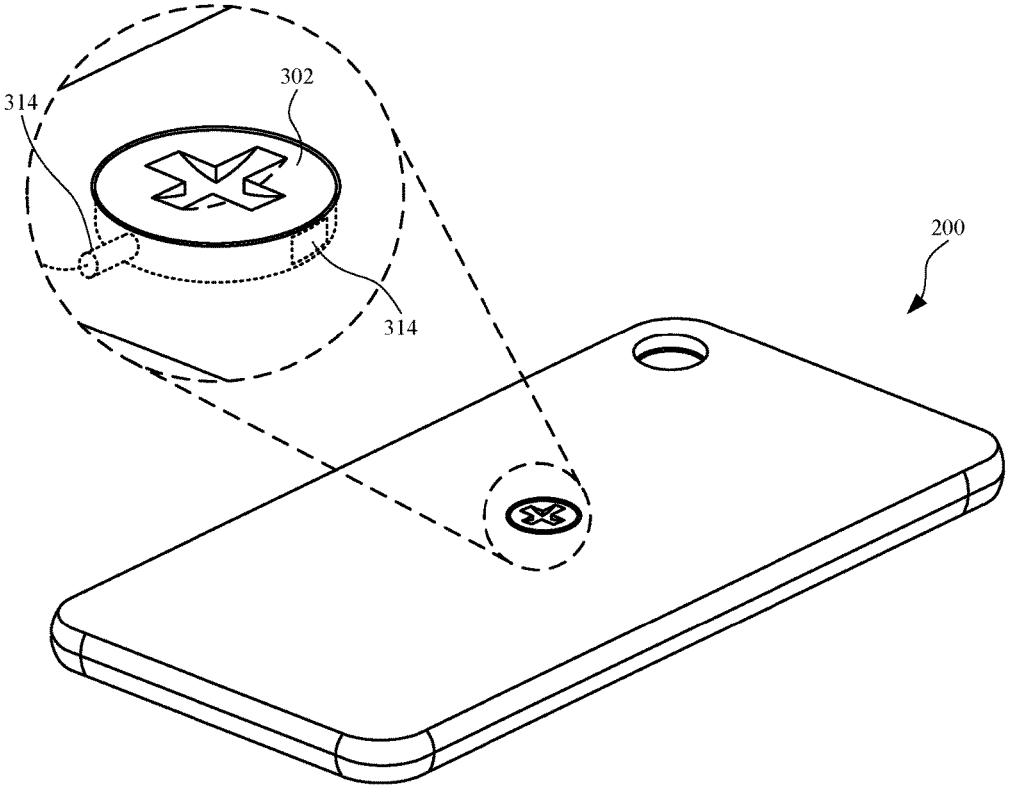
FIG. 6 illustrates an isometric view of a rear portion of the accessory device, showing a latch mechanism in an unlocked configuration.

FIG. 6 illustrates an isometric view of a rear portion of the accessory device 200, showing the latch mechanism 302 in an unlocked configuration. As shown in the enlarged view, the target 314 of the latch mechanism 302 is positioned such that the detection mechanism 312 cannot identify the target 314. Accordingly, the detection mechanism 312 may provide an input (in the form of an electrical signal) to the processor circuit 216 (shown in FIG. 3) or to the electronic device, indicating the unlocked configuration. Alternatively, the detection mechanism 312 may provide no indication until the target 314 is identified.

Figure 7:
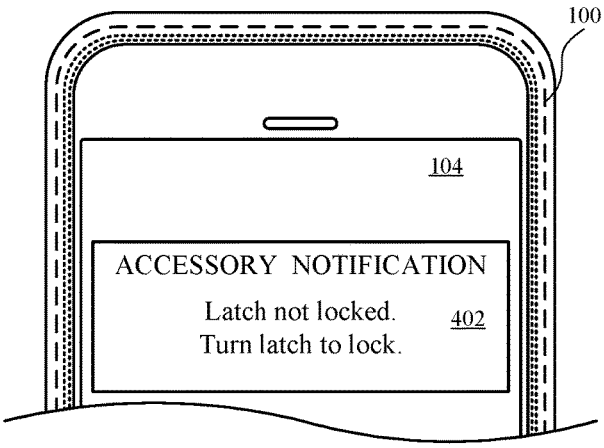
FIG. 7 illustrates a plan view of the electronic device positioned in the accessory device, showing the display presenting a message based upon a configuration of the accessory device, in accordance with the described embodiments.

When the latch mechanism 302 is in the unlocked configuration, the electronic device 100 may present a message on the display 104 (shown in FIG. 1). For example, FIG. 7 illustrates a plan view of the electronic device 100 positioned in the accessory device 200, showing the display 104 presenting a message 402 based upon a configuration of the accessory device 200, in accordance with the described embodiments. As shown, the message 402 presented on the display 104 indicates the latch mechanism 302 (shown in FIG. 6) is in the unlocked configuration. The message 402 may change according to the various conditions previously described. For example, the message 402 may indicate a misalignment between the electronic device 100 and the accessory device 200, a misalignment between parts of the accessory device, and/or a lack of pressure to the outer protective layer. Further, in some embodiments, the message 402 may include a corrective action. Regarding the latter, as shown in FIG. 7, the message 402 may describe a corrective action associated with the unlocked position of the latch mechanism 302, which may include a notification to the user to turn the latch mechanism 302 to place the latch mechanism 302 in the locked position. Also, the message 402 may indicate the accessory device 200 is properly installed with the electronic device 100, providing confirmation to the user that the accessory device 200 is properly configured.

Figure 8:
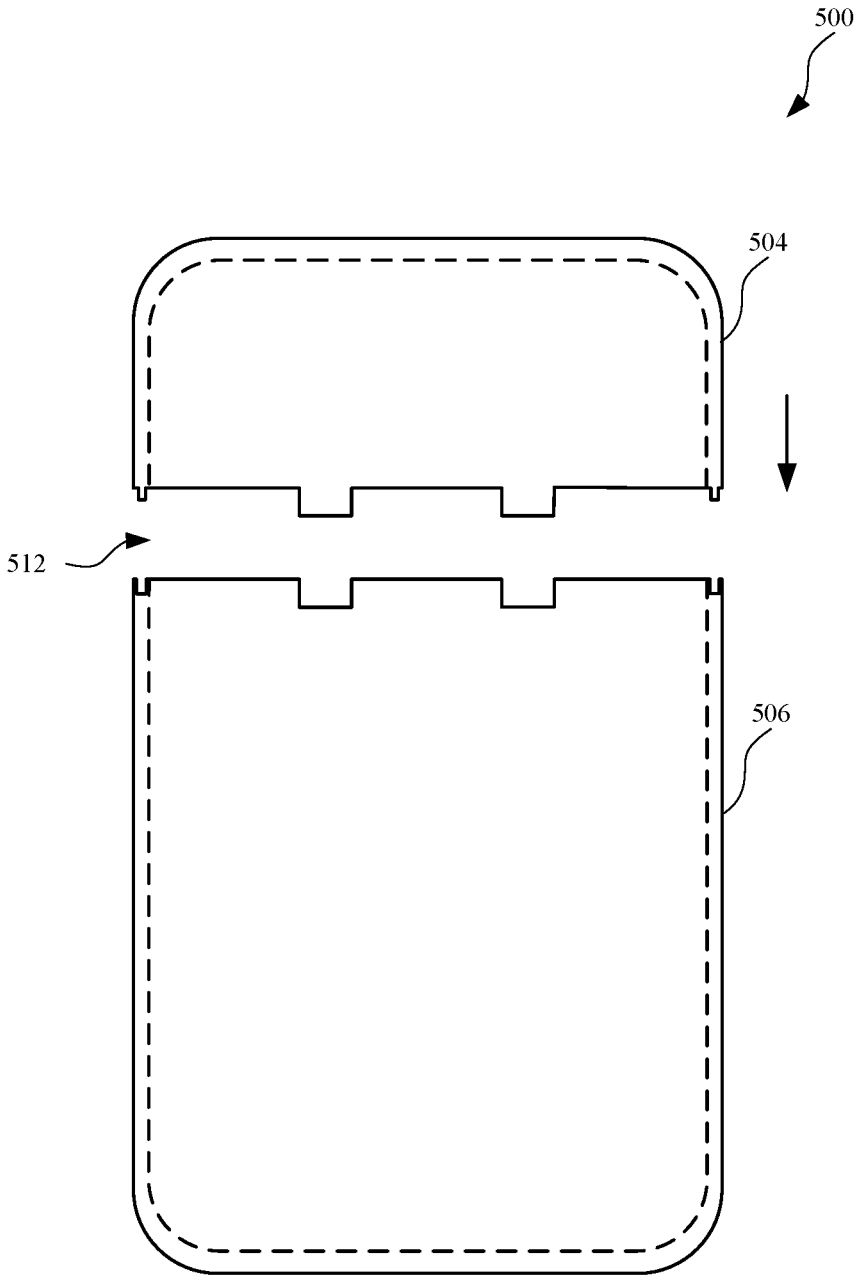
FIG. 8 illustrates a plan view of an alternative embodiment of an accessory device, showing the accessory device partitioned in an alternate manner.
Figure 9:
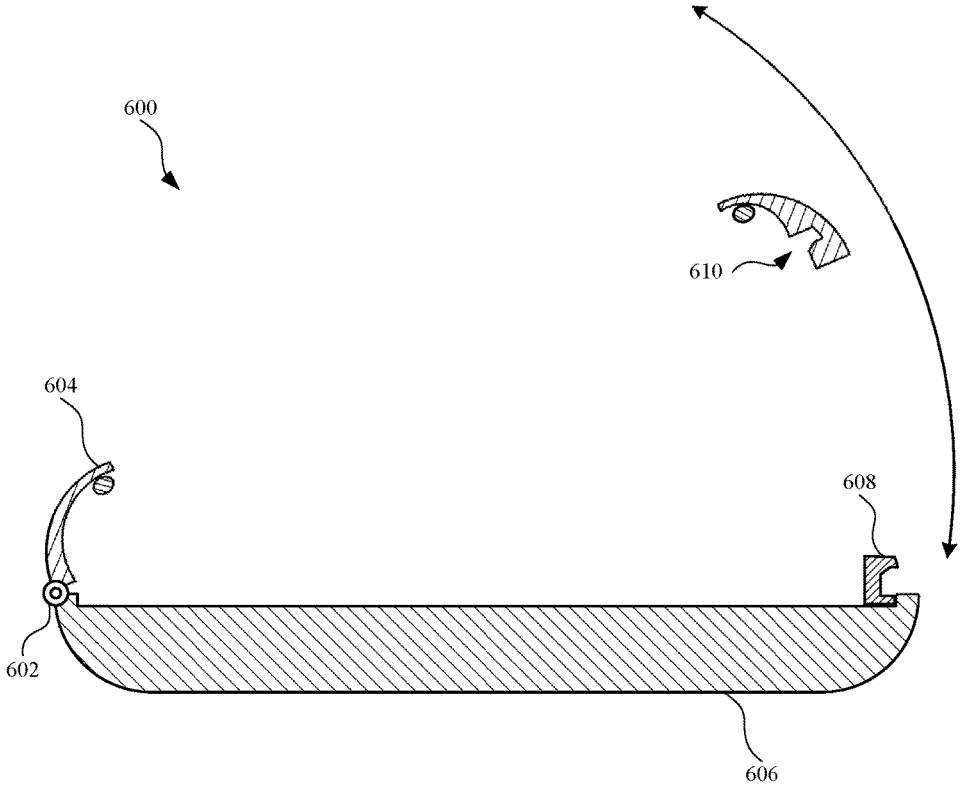
FIG. 9 illustrates a cross sectional view of an alternative embodiment of an accessory device, with the accessory device having a hinge assembly.

FIGS. 8 and 9 illustrate alternative embodiments of an accessory device. However, although not described, the embodiments shown in FIGS. 8 and 9 may include any feature or features previously described for an accessory device. FIG. 8 illustrates a plan view of an alternative embodiment of an accessory device 500, showing the accessory device 500 partitioned in an alternate manner. For example, the accessory device 500 may include a first part 504 and a second part 506 divided laterally, with the first part 504 designed to fit over an uppermost region of an electronic device (not shown), and the second part 506 designed to fit over a lowermost region (or region other than the uppermost region) of the electronic device. This configuration may allow for an accessory device 500 to include a reduced interface region, defined by the partition, between the first part 504 and the second part 506, resulting in a reduced location or region through which ingress can pass through the accessory device 500.

FIG. 9 illustrates a cross sectional view of an alternative embodiment of an accessory device 600, with the accessory device 600 having a hinge assembly 602. The hinge assembly 602 may allow a first part 604 to pivot or rotate with respect to a second part 606, or vice versa. For example, the hinge assembly 602 may allow the first part 604 to rotate away from the second part 606 in order to receive or remove an electronic device (not shown) from the accessory device 600. In some embodiments, the second part 606 may include a hook 608 to receive a cavity 610 located in the first part 604. The hook 608 may be spring-loaded, or otherwise designed to actuate in response to engaging the first part 604 to receive first part 604 at the cavity 610. This may allow for an accessory device 600 to include a single attached body that reduces the likelihood losing the first part 604 and/or the second part 606.

Figure 10:
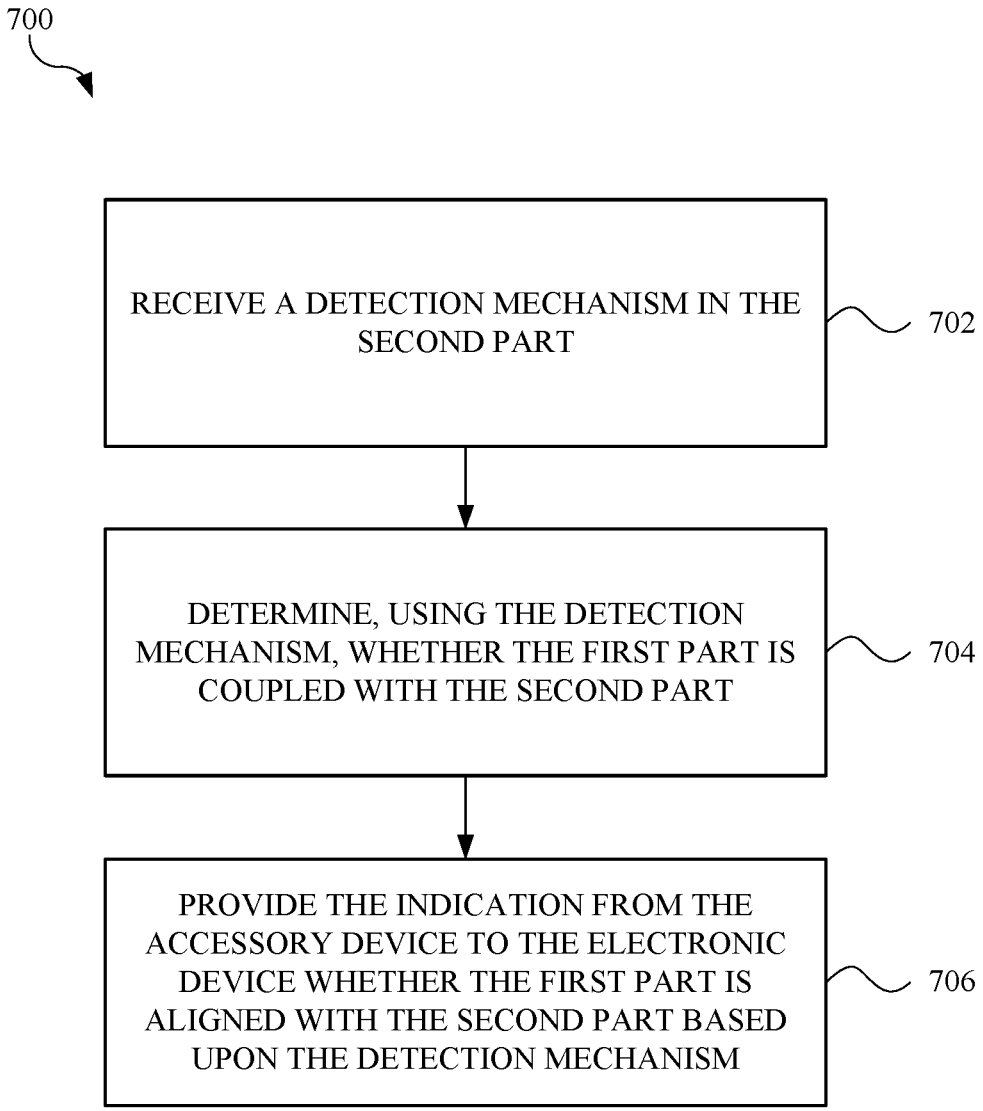
FIG. 10 illustrates a flowchart showing a method for forming an accessory device suitable as a protective cover for an electronic device, in accordance with the described embodiments.

FIG. 10 illustrates a flowchart 700 showing a method for forming an accessory device suitable as a protective cover for an electronic device, in accordance with the described embodiments. In step 702, a first part and a second part are formed. The first part and the second part can combine with one another part to provide the protective cover. In some embodiments, the first part includes an extension. Further in some embodiments, the second part includes a receptacle to receive the extension.

In step 704, a detection mechanism is provided. The detection mechanism is configured to detect a coupling between the first part and the second part and communicate the coupling to the electronic device. In some embodiments, the detection mechanism provides an input to a processor circuit in the accessory device. The input may correspond to the detection mechanism not detecting the extension in the receptacle. In this manner, the accessory device may communicate to the electronic device that the first part is not properly aligned with respect to the second part, corresponding to a misalignment between the first part and the second part. The means for passing the indication from the accessory device (or the processor circuit) to the electronic device may include a direct communication by an electrical coupling between the accessory device and the electronic device, or a wireless communication. Based upon the output from the accessory device, the electronic device may generate and present a message that is presented on a display of the electronic device, indicating to a user that the first part is not properly aligned with the second part. The message may further suggest a corrective action to the user.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An accessory device suitable for use with an electronic device having a display, the accessory device comprising:

a body configured to receive the electronic device, the body comprising:

a first part comprising an extension, a second part separable from the first part, the second part comprising a receptacle capable of receiving the extension to couple the first part with the second part; and a detection mechanism carried by the body and configured to provide an indication to the electronic device when the extension is detected by the detection mechanism, the indication triggering the electronic device to present on the display a message in accordance with the first part being coupled with the second part.

2. The accessory device of claim 1, wherein the first part comprises a sealing element that includes a compressible material such that when the first part and the second part enclose the electronic device, the compressible material engages the electronic device and elastically deforms to form an ingress barrier at an interface between the compressible material and the electronic device.

3. The accessory device of claim 1, wherein the second part comprises:

a latch mechanism configured to lock the first part with the second part defining a locked configuration, the latch mechanism comprising a target; and a second detection mechanism configured to detect the target in the locked configuration and provide a third indication of the locked configuration.

4. The accessory device of claim 3, wherein the latch mechanism is rotationally actuated to change from the locked configuration to an unlocked configuration to decouple the first part from the second part, and wherein the target is positioned away from the second detection mechanism in the unlocked configuration.

5. The accessory device of claim 4, wherein the third indication triggers the electronic device to present a second message on the display in accordance with the latch mechanism.

6. The accessory device of claim 1, wherein the first part comprises an opening that provides access to the display.

7. The accessory device of claim 1, wherein the body comprises a processor circuit that 1) receives an input from the detection mechanism that the electronic device is in the body, and 2) generates the indication to the electronic device based on the input, the indication triggering the electronic device to present the message on the display.

8. An accessory device suitable as a protective cover for an electronic device, the accessory device comprising:

a first part;

a second part that combines with the first part to provide the protective cover, the second part comprises a latch mechanism configured to lock the first part with the second part based upon a rotation of the latch mechanism; and a detection mechanism capable of detecting a position of the latch mechanism; and a processor circuit carried by one of the first part and the second part, the processor circuit capable of receiving, from the detection mechanism, an indication corresponding to the position to the latch mechanism, wherein the processor circuit communicates to the electronic device that the first part is coupled with the second part based on the indication.

9. The accessory device of claim 8, wherein:

the first part comprises an extension, the second part comprises a receptacle that receives the extension, the detection mechanism is positioned proximate to the receptacle to detect the extension.

10. The accessory device of claim 8, further comprising a sealing element compressed between the first part and the electronic device.

11. The accessory device of claim 8, wherein the second part comprises:

and a second detection mechanism configured to detect the electronic device, the second detection mechanism configured to provide a second indication to the processor circuit based upon whether the electronic device is in contact with the second part.

12. A method for forming an accessory device suitable as a protective cover for an electronic device, the method comprising:

forming a first part and a second part that combines with the first part to provide the protective cover, the first part comprising an extension, the second part separable from the first part, the second part comprising a receptacle capable of receiving the extension to couple the first part with the second part; and providing a detection mechanism configured to i) detect the extension is detected, ii) provide an indication of a coupling between the first part and the second part and, iii) communicate the coupling to the electronic device.

13. The method of claim 12, wherein the detection mechanism comprises a proximity sensor.

14. The method of claim 12, wherein forming the second part comprises forming a latch mechanism in the second part, the latch mechanism configured to lock the first part with the second part based upon a rotation of the latch mechanism.

15. The method of claim 14, further comprising providing a second detection mechanism that detects a position of the latch mechanism and provides a second indication corresponding to the position to the latch mechanism.

16. The method of claim 12, wherein forming the first part comprises forming a sealing element along the first part such that the sealing element is compressed between the first part and the electronic device.

17. The accessory device of claim 8, wherein the indication causes a display of the electronic device to present a message that indicates the latch mechanism is locked.

18. The accessory device of claim 8, wherein the latch mechanism is capable of being rotationally driven.

19. The accessory device of claim 8, wherein the second part comprises an electrical contact configured to electrically couple with the electronic device.

* * * * *